US008092653B2

(12) United States Patent
Lundberg

(10) Patent No.: US 8,092,653 B2
(45) Date of Patent: Jan. 10, 2012

(54) ROLL BODY FOR A PRESS ROLL

(75) Inventor: Jörgen Lundberg, Sundsvall (SE)

(73) Assignee: Metso Paper, Inc. (FI)

( * ) Notice: Subject to any disclaimer, the term of this patent is extended or adjusted under 35 U.S.C. 154(b) by 754 days.

(21) Appl. No.: 11/988,340

(22) PCT Filed: May 22, 2006

(86) PCT No.: PCT/SE2006/050151

§ 371 (c)(1),
(2), (4) Date: Jan. 3, 2008

(87) PCT Pub. No.: WO2007/004968

PCT Pub. Date: Jan. 11, 2007

(65) Prior Publication Data

US 2009/0120602 A1 May 14, 2009

(30) Foreign Application Priority Data

Jul. 4, 2005 (SE) ..... 0501550

(51) Int. Cl.
*D21G 9/00* (2006.01)

(52) U.S. Cl. ..... 162/289; 162/358.1; 210/123; 210/404

(58) Field of Classification Search ..... 162/289, 162/358.1; 210/123, 404
See application file for complete search history.

(56) References Cited

U.S. PATENT DOCUMENTS 3,014,589 A 12/1961 Frykhult
6,311,849 B1 11/2001 Sbaschnigg et al.

FOREIGN PATENT DOCUMENTS

WO WO-97/21868 A1 6/1997

*Primary Examiner* — Matthew Daniels
*Assistant Examiner* — Jacob Thomas Minskey
(74) *Attorney, Agent, or Firm* — Lerner, David, Littenberg, Krumholz & Mentlik, LLP

(57) ABSTRACT

A press roll for washing pulp is disclosed, comprising a central drum and mantle section to which at least one perforated roll plate is attached, comprising a plurality of first and second chambers between the central drum and the roll plate. The chambers of each pair are separated from each other, the first chamber includes at least one inlet defining a radial flow path and the second chamber comprising at least one inlet defining a tangential flow path. At one end of the press roll, the first chamber includes a discharge and the second chamber is closed, and at the other end of the press roll, the second chamber includes an outlet and the first chamber is closed.

12 Claims, 3 Drawing Sheets

ROLL BODY FOR A PRESS ROLL

FIELD OF THE INVENTION

The present invention relates to a roll body for a press roll for washing pulp, comprising a central drum and mantle section to which at least one perforated roll plate is intended to be attached, Further, the present invention relates to a roll press for washing pulp, comprising two press rolls between which the pulp is passed in a vertical direction from below upwards, where at least one press roll comprises such a roll body.

BACKGROUND OF THE INVENTION

When producing cellulose-based products, a roll press is frequently present for dewatering the cellulose-based pulp. The pulp is passed between two cooperating press rolls in a roll press, the press rolls having a perforated envelope surface, whereby the envelope surface is permeable to liquid pressed out of the pulp, and is pressed in the roll nip, or the press nip, between the press rolls, whereby liquid is pressed out of the pulp. One example of such a roll press for dewatering pulp is disclosed in Swedish Patent No. 505,539, e.g., where the central axes of the press rolls lie in substantially the same horizontal plane, and the pulp passes the press nip between the press rolls in a vertical direction, from below upwards.

Swedish Patent No. 519,753 describes the sealing of a press roll in a roll press having two cooperating press rolls for dewatering material suspensions.

The above mentioned roll presses have in common that their roll bodies have a conventional structure, where the roll body comprises a longitudinal central drum, which can comprise a drum or an inner drum covered with a covering plate, or the like. The central drum is provided with several supporting ribs arranged longitudinally along the longitudinal axis of the central drum and evenly distributed along the circumference of the central drum. The purpose of these supporting ribs is to strengthen the structure, and also to provide channels which axially guide liquid pressed out of the pulp to the ends of the press roll. On these supporting ribs, a mantle section is attached, comprising several circumferential frame rings which are surrounding the roll body along its entire length, the purpose of which is to be a supporting structure for the perforated roll plates which are positioned outermost on the press roll, since the roll plates are abutting the frame rings around their whole circumference, and to allow expressed liquid, which has passed through the roll plate, to fall downwards after the passage through the apertures of the roll plate. This is important in order to reduce the rewetting, i.e. the liquid which, after the press nip, flows back through the roll plate and dilutes the pressed pulp, especially for roll presses where the pulp is passed through the press nip between two press rolls in a vertical direction from below upwards, such as in Swedish Patent No. 505,539. The result of this rewetting is that the resulting dryness of the pressed pulp from the roll press is lower, and that the pulp is contaminated by lye or liquid previously pressed out.

U.S. Pat. No. 6,311,849, upon which the preamble of claim 1 is based, discloses an apparatus for dewatering and washing pulp, comprising two press rolls, between which the pulp is passed in a vertical direction from below upwards, the rotation axes of the press rolls lying on a horizontal plane. The press rolls comprise several pairs of chambers arranged longitudinally along the longitudinal axis of the central drum and between the central drum and the roll plate, the chambers of a pair being separated from each other, and the first chamber of the pair comprises inlets for liquid, which defines a flow path in a substantially radial direction, whereas the second chamber of the pair comprises at least one inflow opening for the inflow of liquid, which define a flow path in a substantially tangential direction. The second chamber of a pair is in direct communication, by means of its inflow opening, with the first chamber of an adjacent pair of chambers for the inflow of liquid from the first chamber. From these chambers, the liquid from the pulp is then axially removed. By this, the rewetting of the pulp is reduced.

One object of the present invention is thus to attain a roll body for a press roll which provides a press roll which, in use in a roll press, is more effective in washing the pulp and provides the required purity of the washed pulp. Further, one object is to attain a roll press for washing pulp comprising press rolls provided with such a roll body.

SUMMARY OF THE INVENTION

In accordance with the present invention, these and other objects have now been realized by the invention of a press roll having a first end and a second end for washing pulp comprising a central drum, at least one perforated roll plate providing a mantle covering the central drum, a plurality of first chambers extending longitudinally along the press roll between the central drum and the at least one perforated roll plate, a plurality of second chambers extending longitudinally along the press roll between the central drum and the at least one perforated roll plate, the pluralities of first and second chambers being paired with each other around a periphery of the press roll, each of the plurality of first chambers including an inlet defining a substantially radial flow path thereinto and an outlet at the first end of the press roll, each of the plurality of second chambers including an inlet defining a substantially tangential flow path thereinto and an outlet at the second end of the press roll, the plurality of first chambers being closed at the second end preventing liquid from being discharged therefrom, and the plurality of second chambers being closed at the first end preventing liquid from being discharged therefrom. Preferably, the at least one perforated roll plate comprises a longitudinally extending wall defining the plurality of first chambers. In a preferred embodiment, the plurality of second chambers are displaced from the at least one perforated roll plate which therefore does not comprise a longitudinally extending wall defining the plurality of second chambers.

In accordance with one embodiment of the press roll of the present invention, the inlet for each of the plurality of second chambers is displaced from the at least one perforated roll plate.

In accordance with another embodiment of the press roll of the present invention, the inlet for each of the plurality of second chambers is displaced from the central drum.

In accordance with another embodiment of the press roll of the present invention, in each adjacent pair of the plurality of first and second chambers the inlet for each of the plurality of second chambers provides direct fluid communication with the adjacent one of the plurality of first chambers so as to provide for the flow of liquid from the plurality of first chambers to the plurality of second chambers.

In accordance with another embodiment of the press roll of the present invention, the press roll includes a plurality of radially extending support ribs extending longitudinally along the central drum and a plurality of longitudinally extending partition members extending between each pair of the plurality of radially extending support ribs thereby dividing the space between the pairs of the plurality of radially extending support ribs into the plurality of first and second chambers, the plurality of longitudinally extending partition members providing a common wall for each of the plurality of first and second chambers, and the plurality of radially extending support ribs including the inlet for the second chamber. In a preferred embodiment, each space between each pair of the plurality of radially extending support ribs includes one of the plurality of longitudinally extending partition members.

In accordance with the present invention, a roll press has been provided for washing pulp comprising a pair of press rolls defining a press nip therebetween for passing the pulp upwardly through the press nip, wherein at least one of the pair of press rolls comprises a press roll as described above. Preferably, upon rotation of the pair of press rolls in a predetermined direction, the inlet for each of the plurality of second chambers in the at least one of the pair of press rolls passes the press nip prior to each of the plurality of first chambers therein.

In accordance with one embodiment of the press roll of the present invention, the inlet for each of the plurality of second chambers is disposed at a predetermined location between the central drum and the at least one perforated roll plate so as to provide a first dewatering zone in which liquid enters the plurality of first chambers through the at least one perforated roll plate and then passes through the plurality of first chambers, and a second dewatering zone wherein the liquid flows into the plurality of second chambers from the plurality of first chambers through the inlet and then passes through the plurality of second chambers. Preferably, the roll press includes inlets for providing new washing liquid into the first dewatering zone of the pair of press rolls.

The above-mentioned objects are achieved by providing a roll body comprising several pairs of chambers arranged along the longitudinal axis of the central drum between the central drum and the roll plate, the chambers of a pair being separated from each other, and the first chamber of the pair comprising at least one inlet for liquid, which defines a flow path in a substantially radial direction, whereas the second chamber of the pair comprises at least one inflow opening for the inflow of liquid which defines a flow path in a substantially tangential direction.

The inflow opening of the second chamber of the pair for the inflow of liquid, which defines a flow path in a substantially tangential direction, can, for example, be attained by providing the second chamber with a longitudinal wall extending in a substantially radial direction and provided with the at least one inflow opening.

By means of the ends of the roll body according to the present invention, a press roll is provided which, in use in a roll press, is more effective in washing the pulp and provides the required purity of the washed pulp. By means of the roll body, a system for fractionating filtrate in a press roll is attained. The filtrate can be separated in two different sections, each of which works in a certain zone in the roll press. In a first zone in the region of the press roll, a first amount of filtrate can be taken up by the first chamber through the roll plate and then discharged at the first end of the roll body, and in a second zone in the region of the press roll, a second amount of filtrate be taken up by the second chamber through the roll plate and then discharged at the second end of the roll body, whereby these two amounts of filtrate are kept completely separated. These amounts of filtrate can then be used for different purposes and at different positions in the process. For example, it is possible to use the amounts of filtrate from the different zones to obtain a counter-current washing stage in a roll press having two press rolls, especially for roll presses where the pulp is passing the press nip between the press rolls in a vertical direction from below upwards.

According to one advantageous embodiment of the roll body according to the present invention, one of the longitudinal walls of the first chamber comprises the roll plate itself, and advantageously, it is only the first chamber of the chambers of the pair, which has a longitudinal wall comprising the roll plate itself, and thus is in direct communication therewith.

According to a further advantageous embodiment of the roll body according to the present invention, the second chamber of a pair is in direct communication, by means of its inflow opening, with the first chamber of an adjacent pair of chambers, for the inflow of liquid from the first chamber. In this manner, the washing and dewatering of the pulp is made even more effective.

According to another advantageous embodiment of the roll body according to the present invention, it comprises several longitudinally extending supporting ribs along the longitudinal axis of the central drum which extend in a substantially radial direction and are distributed over the circumference of the central drum, to which the mantle section is attached, where a partition, extending longitudinally along the longitudinal axis of the central drum, is arranged in the space between two supporting ribs, whereby the pair of chambers is provided between the two supporting ribs with the partition as a common wall, and one of the supporting ribs is provided with the inflow opening of the second chamber. Advantageously, such a partition is arranged in all the spaces between two supporting ribs. Through the use of existing supporting ribs, the required amount of material is minimized when manufacturing the chambers.

According to one advantageous embodiment of the roll press according to the present invention, the chambers of a pair are arranged in relation to each other in such a way that the inflow opening of the second chamber of the pair passes the press nip before the first chamber of the pair.

According to a further advantageous embodiment of the roll press according to the present invention, the inflow opening of the second chamber is arranged at such a position in relation to envelope surface of the central drum and the roll plate that a first and a second dewatering zone are provided in the roll press, in which first dewatering zone liquid from the pulp is let in to the first chamber through the perforated roll plate and is thereafter conveyed through the first chamber, and in which second dewatering zone liquid from the pulp is flowing in to the second chamber through the perforated roll plate, the first chamber, and the inflow opening, and is thereafter conveyed through the second chamber.

According to another advantageous embodiment of the roll press according to the present invention, the inlets of the roll press for new washing liquid open into/have their outflow in the first dewatering zone. However, other positions of the said inlets are possible.

BRIEF DESCRIPTION OF THE DRAWINGS

The present invention will now be described, for exemplary purposes, in more detail by way of embodiments set forth in the following detailed description which, in turn, refers to the enclosed drawings, in which.

DETAILED DESCRIPTION

Figure 1:
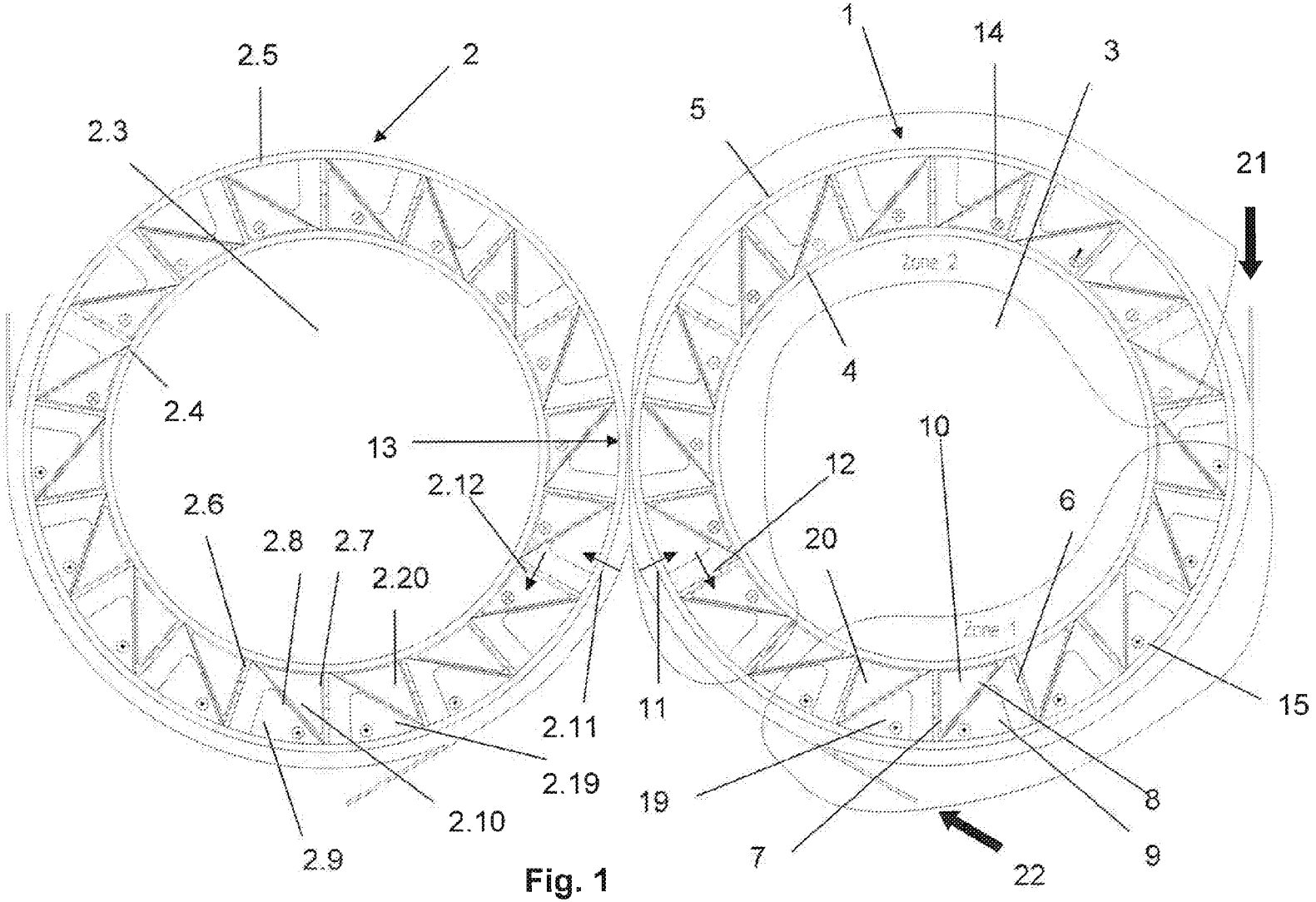
FIG. 1 is a side, elevational, schematic cross-sectional view of two press rolls, each comprising one embodiment of the roll body according to the present invention provided with perforated roll plates.

FIG. 1 shows a schematic cross-sectional view of a first and a second press roll, 1 and 2, for washing pulp, each comprising an embodiment of the roll body, 3 and 2.3, according to the present invention. The roll body, 3 and 2.3, comprises a central drum, 4, 2.4, and mantle section to which at least one perforated roll plate, 5 and 2.5, is intended to be attached. Further, the roll body, 3 and 2.3, comprises along the longitudinal axis of the central drum, 4 and 2.4, several longitudinally extending supporting ribs, 6, 7, 2.6, and 2.7, which extend in a substantially radial direction and are distributed over the circumference of the central drum, 4 and 2.4, to which the mantle section is attached. The mantle section can in a conventional way comprise several frame rings which are arranged along the longitudinal axis of the central drum, 4 and 2.4, and attached to the supporting ribs, 6, 7, 2.6, and 2.7, by means of several flat bars. In each space between two supporting ribs, 6, 7, 2.6, and 2.7, a partition, 8 and 2.8, extending longitudinally along the longitudinal axis of the central drum, 4 and 2.4, is arranged, whereby in each space between two supporting ribs, 6, 7, 2.6, and 2.7, a pair of chambers, 9, 2.9, 10, and 2.10, is provided, which chambers, 9, 2.9, 10, and 2.10, extend longitudinally along the longitudinal axis of the central drum, 4 and 2.4, between the central drum, 4 and 2.4, and the roll plate, 5 and 2.5. The chambers, 9, 10, 2.9, and 2.10, of pair are completely separated from each other by the partition, 8 and 2.8. The first chamber, 9 and 2.9, of the pair comprises an inlet for liquid, which defines a flow path, 11 and 2.11, in a substantially radial direction, in the form of the apertures provided in the roll plate, 5 and 2.5. One of the longitudinal walls of the first chamber, 9 and 2.9, comprises the roll plate, 5 and 2.5, itself, and it is only the first chamber, 9 and 2.9, of the chambers, 9, 2.9, 10, and 2.10, of the pair, which has a longitudinal wall comprising the roll plate, 5 and 2.5, itself, and thus is in direct communication therewith. The second chamber, 10 and 2.10, of the pair comprises at least one inflow opening for the inflow of liquid, which defines a flow path, 12 and 2.12, in a substantially tangential direction. In the roll press of FIG. 4, the flow path, 12 and 2.12, extends against the direction of rotation of the press roll, 1 and 2. The inflow opening of the second chamber, 10 and 2.10, is provided in one of the supporting ribs, 7 and 2.7. The inflow opening of the second chamber, 10 and 2.10, is arranged at a distance from the roll plate, 5 and 2.5, and from the envelope surface of the central drum, 4 and 2.4. The second chamber, 10 and 2.10, of a pair is in direct communication, by means of its inflow opening, with the first chamber, 19 and 2.19, of an adjacent pair of chambers, 19, 2.19, 20, and 2.20, for the inflow of liquid from the first chamber, 19 and 2.19. The above-mentioned construction results in the wall of the second chamber, 10 and 2.10, of a pair, which consists of the supporting rib, 7 and 2.7, provided with the inflow opening, also forms one of the walls of the first chamber, 19 and 2.19, of the adjacent pair. The first chambers, 9, 2.9, 19, and 2.19, are in communication with the entire inner surface of the roll plate, 5 and 2.5, whereby all of the liquid let in through the roll plate, 5 and 2.5, first reaches the first chambers, 9 and 2.9; 19 and 2.19. The chambers, 9, 2.9, 10, and 2.10; 19, 2.19, 20, and 2.20, of a pair are arranged in relation to each other in such a way that the inflow opening of the second chamber, 10, 2.10; 20, and 2.20, of a pair is passing the press nip 13 before the first chamber, 9, 2.9, 19, and 2.19, of the pair. In the figure, the longitudinal flow of the liquid in each chamber, 9, 2.9, 10, 2.10; 19, 2.19, 20, and 2.20, is illustrated by means of a cross symbol 14 indicating that the flow in each chamber, 10 and 2.10; 20 and 2.20, flows in a direction into the plane of the drawing, and a point symbol 15 indicating that the flow in each chamber, 9, 2.9; 19, and 2.19, flows in a direction out of the plane of the drawing.

Figure 2:
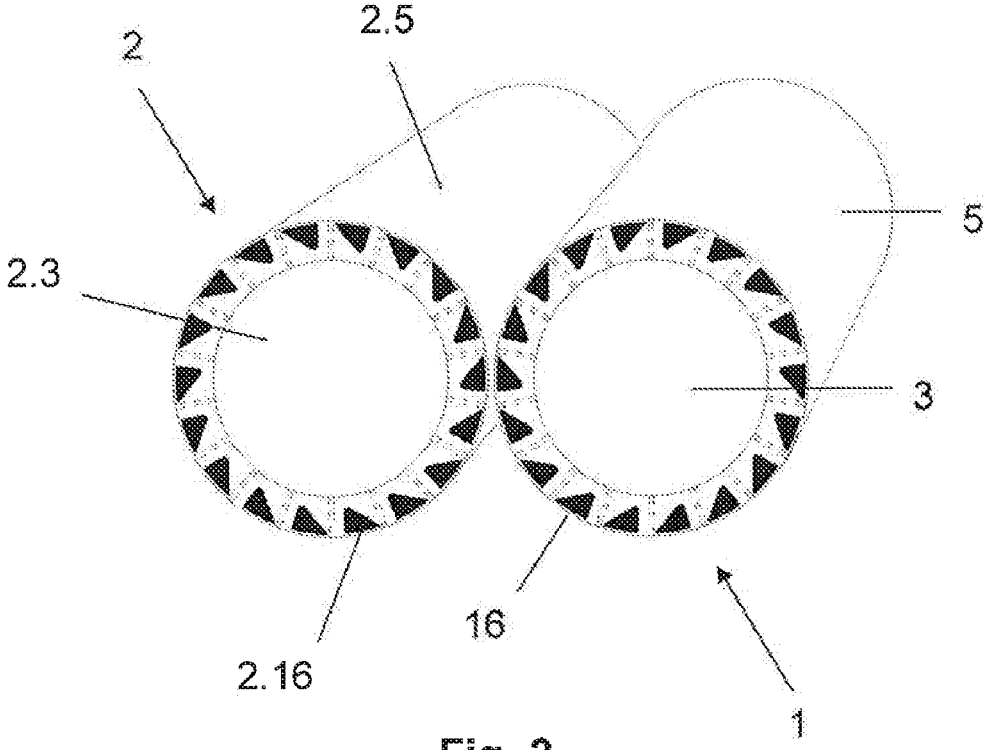
FIG. 2 is a side, perspective, schematic view of the press rolls of FIG. 1, where the first end of each roll body is shown.

FIG. 2 shows in a perspective view the press rolls, 1 and 2, of FIG. 1, where the first end of each roll body, 3 and 2.3, is shown. At this first end of the roll body, 3 and 2.3, the first chambers are provided with outlets, 16 and 2.16, indicated by black fields in the figure, for the discharge of liquid, whereas the second chambers are closed there, whereby discharge of liquid from the second chambers at the first end of the press roll is prevented.

Figure 3:
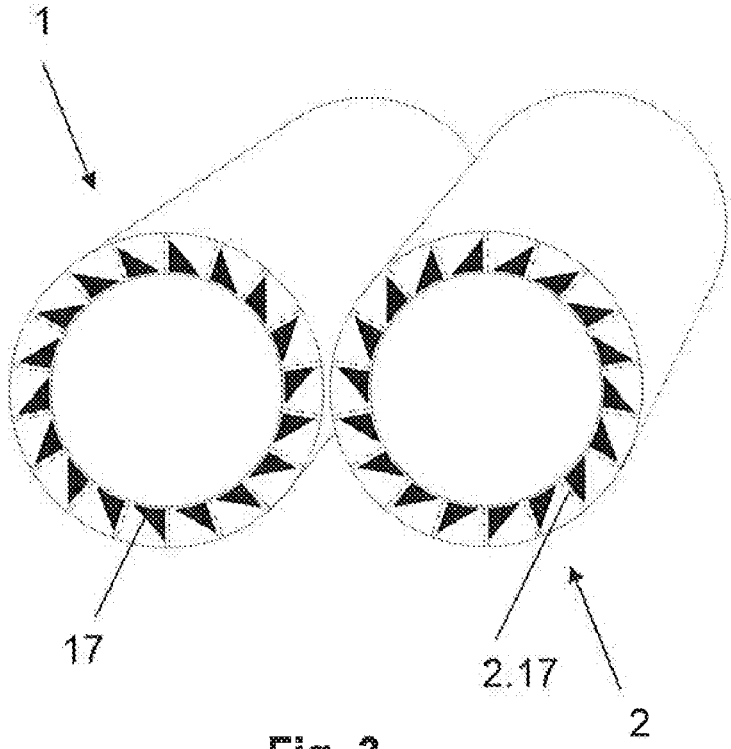
FIG. 3 is a side, perspective, schematic view of the press rolls of FIG. 1, where the second end of each roll body is shown.

FIG. 3 shows in a perspective view the press rolls, 1 and 2, of FIG. 1 where the second end of each roll body, 3 and 2.3, is shown. At this second end of the roll body, 3 and 2.3, the second chambers are provided with outlets, 17 and 2.17, indicated by black fields in the figure, for the discharge of liquid, whereas the first chambers are closed there, whereby discharge of liquid from the first chambers at the second end of the press roll is prevented.

Returning to FIG. 1, the inflow opening of each second chamber, 10 and 2.10; 20 and 2.20, is arranged at such a position in relation to the envelope surface of the central drum, 4 and 2.4, and the roll plate, 5 and 2.5, that a first dewatering zone Zone 1 and a second dewatering zone Zone 2 are provided in the roll press in which the press rolls are provided (see FIG. 1). In the first dewatering zone Zone 1, liquid from the pulp is let in to the first chambers, 9, 2.9, 19, and 2.19, through the perforated roll plate, 5 and 2.5, and is thereafter conveyed through the first chambers, 9, 2.9, 19, and 2.19, to be discharged thereafter through the outlets of said chambers, 9, 2.9, 19, and 2.19, at the first end of the roll body, 3 and 2.3. In the second dewatering zone Zone 2, liquid from the pulp is flowing in to the second chambers, 10 and 2.10; 20 and 2.20, through the perforated roll plate, 5 and 2.5, the first chambers, 9, 2.9, 19, and 2.19, and each inflow opening, and is thereafter conveyed through the second chambers, 10 and 2.10; 20 and 2.20, to be discharged thereafter via the outlets of said chambers, 10, 2.10; 20, 2.20, at the second end of the roll body, 3 and 2.3. The inlets, 21 and 22, of the roll press for new washing liquid open into/have their outflow in the first dewatering zone Zone 1.

Figure 4:
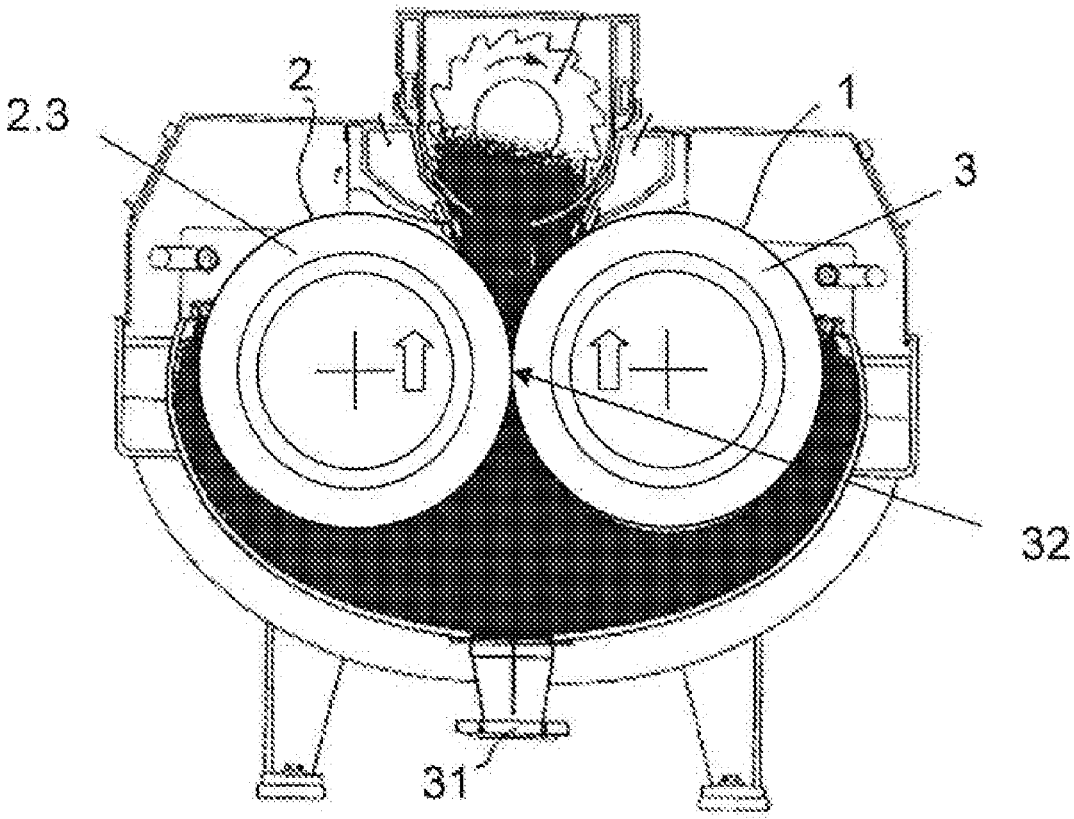
FIG. 4 is a side, elevational, schematic, sectional view of an embodiment of the roll press according to the present invention.

FIG. 4 shows an embodiment of the roll press for washing pulp according to the present invention, comprising a first press roll 1 and a second press roll 2, as shown in FIG. 1-3, and each press roll, 1 and 2, thus comprises a roll body, 3 and 2.3, as shown in FIG. 1-3. The longitudinal central axes of the press rolls, 1 and 2, are lying in substantially the same horizontal plane. The pulp is fed in through an inlet 31 and pressed up towards the press nip 32 between the first and second press rolls, 1 and 2, the rotation of which is indicated by vertically pointing arrows in the figure, whereby the pulp is passing the press nip 32 vertically upwards, where the pulp is dewatered and is pressed further up in a vertical direction.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A press roll having a first end and a second end for washing pulp comprising a central drum, at least one perforated roll plate providing a mantle covering said central drum, a plurality of first chambers extending longitudinally along said press roll between said central drum and said at least one perforated roll plate, a plurality of second chambers extending longitudinally along said press roll between said central drum and said at least one perforated roll plate, said pluralities of first and second chambers being paired with each other around a periphery of said press roll, each of said plurality of first chambers including an inlet defining a substantially radial flow path thereinto, an outlet at said first end of said press roll, and a substantially continuous first flow channel between said inlet and said outlet, each of said plurality of second chambers including an inlet defining a substantially tangential flow path thereinto, an outlet at said second end of said press roll, and a substantially continuous second flow channel extending between said inlet and said outlet, said plurality of first chambers being closed at said second end preventing liquid from being discharged therefrom, and said plurality of second chambers being closed at said first end preventing liquid from being discharged therefrom, whereby the direction of said flow within said substantially continuous first flow channel is opposite to the direction of said flow within said substantially continuous second flow channel.

2. The press roll of claim 1 wherein said at least one perforated roll plate comprises a longitudinally extending wall defining said plurality of first chambers.

3. The press roll of claim 2 wherein said plurality of second chambers are displaced from said at least one perforated roll plate which therefore does not comprise a longitudinally extending wall defining said plurality of second chambers.

4. The press roll of claim 1 wherein said inlet for each of said plurality of second chambers is displaced from said at least one perforated roll plate.

5. The press roll of claim 1 wherein said inlet for each of said plurality of second chambers is displaced from said central drum.

6. The press roll of claim 1 wherein in each adjacent pair of said plurality of first and second chambers said inlet for each of said plurality of second chambers provides direct fluid communication with said adjacent one of said plurality of first chambers so as to provide for the flow of liquid from said plurality of first chambers to said plurality of second chambers.

7. The press roll of claim 1 including a plurality of radially extending support ribs extending longitudinally along said central drum and a plurality of longitudinally extending partition members extending between each pair of said plurality of radially extending support ribs thereby dividing said space between said pairs of said plurality of radially extending support ribs into said plurality of first and second chambers, said plurality of longitudinally extending partition members providing a common wall for each of said plurality of first and second chambers, and said plurality of radially extending support ribs including said inlet for said second chamber.

8. The press roll of claim 7 wherein each space between each pair of said plurality of radially extending support ribs includes one of said plurality of longitudinally extending partition members.

9. A roll press for washing pulp comprising a pair of press rolls defining a press nip therebetween for passing said pulp upwardly through said press nip, wherein at least one of said pair of press rolls comprises the press roll of claim 1.

10. The roll press of claim 9 wherein upon rotation of said pair of press rolls in a predetermined direction, said inlet for each of said plurality of second chambers in said at least one of said pair of press rolls passes said press nip prior to each of said plurality of first chambers therein.

11. The roll press of claim 9 wherein said inlet for each of said plurality of said chambers is disposed at a predetermined location between said central drum and said at least one perforated roll plate so as to provide a first dewatering zone in which liquid enters said plurality of first chambers through said at least one perforated roll plate and then passes through said plurality of first chambers, and a second dewatering zone wherein said liquid flows into said plurality of second chambers from said plurality of first chambers through said inlet and then passes through said plurality of second chambers.

12. The roll press of claim 11 including inlets for providing previously presented washing liquid into said first dewatering zone of said pair of press rolls.

* * * * *